US007114424B2

(12) United States Patent
Muller et al.

(10) Patent No.: US 7,114,424 B2
(45) Date of Patent: Oct. 3, 2006

(54) WIRE SAWING DEVICE

(75) Inventors: Andreas Muller, Weggis (CH); Alexander Bortnikov, Moscou (RU)

(73) Assignee: HCT Shaping Systems S.A., Cheseax-sur-Lausanne (FR)

( * ) Notice: Subject to any disclaimer, the term of this patent is extended or adjusted under 35 U.S.C. 154(b) by 209 days.

(21) Appl. No.: 10/752,524

(22) Filed: Jan. 8, 2004

(65) Prior Publication Data

US 2004/0159316 A1 Aug. 19, 2004

(30) Foreign Application Priority Data

Jan. 13, 2003 (CH) ..... 43/03
Jul. 18, 2003 (CH) ..... 1263/03

(51) Int. Cl.
*B26D 1/553* (2006.01)
*B28D 1/08* (2006.01)
*B24B 27/06* (2006.01)

(52) U.S. Cl. ..... 83/459; 83/452; 83/460; 83/651.1; 125/16.02; 125/21

(58) Field of Classification Search ..... 83/651.1, 83/78, 451, 452, 459, 460, 465; 125/12, 125/16.01, 16.02, 21
See application file for complete search history.

(56) References Cited

U.S. PATENT DOCUMENTS 5,715,806 A * 2/1998 Tonegawa et al. ..... 125/16.02
5,839,425 A * 11/1998 Toyama et al. ..... 125/16.02
6,119,673 A 9/2000 Nakaura
6,832,606 B1 * 12/2004 Yamada et al. ..... 125/16.02 X

FOREIGN PATENT DOCUMENTS

JP 03281309 12/1991
JP 09272122 10/1997
JP 2002205255 7/2002

* cited by examiner

*Primary Examiner*—Clark F. Dexter
(74) *Attorney, Agent, or Firm*—Young & Thompson

(57) ABSTRACT

A sawing device includes a holding device (22) arranged so as to hold in the course of wire sawing the different sawed slices (23) substantially parallel and such that the width of the sawing gaps (24) is held constant. The device includes, for this purpose, holding members (25), for example in the form of a bar (30) whose resilient coating (31) is applied by springs (35) against a lower portion (26) of the slices (23). There are thus obtained slices without undulations, striations, breakages and irregularities; moreover, the invention permits easy repair of the layer of wires after breakage of the wire.

4 Claims, 8 Drawing Sheets

WIRE SAWING DEVICE

BACKGROUND OF THE INVENTION

The present invention relates to a wire sawing device comprising at least one layer of wires stretched between at least two wire guide cylinders and held in position by grooves provided on the surface of said cylinders, which wire guides define the interval between the wires of the layer of wires, and hence the thickness of the sawed slices separated from each other by sawing gaps, the wires being adapted to move with alternating or continuous movement whilst bearing against at least one piece to be sawed fixed on a support table.

DESCRIPTION OF THE RELATED ART

Wire sawing devices of the mentioned type with movement of the wires of the layer of wires or the piece to be sawed are already known, particularly in the industry of electronic components of ferrites, quartz and silica, to obtain thin slices of material such as poly- or monocrystalline silicon or new materials such as GaAs, InP, GGG or else quartz, synthetic sapphire, ceramic materials. The high price of the materials renders wire sawing more attractive compared to other techniques such as diamond disc sawing.

In the known devices, the sawing region is constituted by an assembly of at least two cylinders in parallel. These cylinders, called wire guides, are engraved with grooves defining the interval between the wires of the layer, namely the thickness of the slices. The piece to be sawed is fixed on a support table which moves perpendicularly to the layer of wires. The speed of movement defines the cutting speed. Renewal of the wire, as well as control of its tension, takes place in a so-called management region for the wire located beyond the sawing region properly so called. The agent which effects the cutting is either an abrasive fixed on the wire, or a free abrasive provided in the form of a slip. The wire acts only as a carrier. During cutting of the piece to be sawed into thin slices, the tensioned wire is both guided and tensioned by the wire guide cylinders.

For numerous applications, the sawed slices or wafers are of a very small thickness relative to the diameter of the piece to be sawed. The sawed slices thus have a substantial flexibility and can flex and curve to come into contact with adjacent slices. This flexing is undesirable for precision and flatness of cutting and can give rise. to undulations, striations and undesirable irregularities on the surface of the sawed slices. These irregularities, even of several micrometers, are enough to render the slices unusable for certain applications, such as silicon for the solar industry and for semiconductors. The deformations of the slices can even lead to micro ruptures and ruptures, especially near the securement of the slices to their support.

Moreover, the variations in the position of the slices and in the width of the sawing gaps are adapted to influence the quantity and distribution of free abrasive in the sawing gaps, which leads in its turn to variations in the thickness of the slices, of the speed of sawing and of the wear on the wire, hence a supplemental increase of the irregularities of the surface of the obtained slices, as well as increased risk of wire breakage.

In the case of wire breakage, it is very difficult or even impossible to repair the wire and to cause it to enter again between the slices which touch each other or whose sawing gap has become very small. It is thus necessary to throw away the piece to be sawed in the case of wire breakage and to begin again sawing with a new piece, which gives rise to considerable loss of material which is often very troublesome and of sawing time.

SUMMARY OF THE INVENTION

The present invention has for its object to overcome these important drawings, and the invention is characterized to this end by the fact that the sawing device comprises a holding device arranged so as to hold, in the course of sawing, the partially or completely sawed slices substantially parallel to each other and such that the width of the sawing gaps is maintained substantially constant during sawing of the slices.

Thanks to these characteristics, it is possible to obtain slices with high planarity, without undulations, striations and undesirable irregularities. Micro ruptures and ruptures are completely avoided.

Because the sawing gaps are held at constant width, there is obtained a regular content and distribution of free abrasive, hence regular sawing without undulations and at constant speed, from one sawing slot to the next.

The wire is moreover subject to regular wear, is hence less subject to breakage. In the case rupture arises, the device according to the invention can also contribute to easy repair of the wire and to replacement of the wire into the saw gaps, hence avoiding throwing away the piece to be sawed when a wire breaks.

Preferably, the holding device comprises holding members adapted to coact with at least one portion of the slices in the course of being sawed.

There is thus obtained an effective holding of the slices during sawing.

According to a preferred embodiment, the holding device comprises guide elements arranged on the support table, the holding members being mounted movably on the guide elements to be moved from an inactive position toward an active position, in which they coact with the slices in the course of sawing, and vice versa.

These characteristics permit a reliable and precise construction.

Preferably, the holding members are urged by resilient members in the direction of stationary abutments.

There is obtained by these characteristics, an automatic operation of the holding device with a reduced number of components.

Advantageously, the holding members are on the one hand in the inactive position, bearing against the stationary abutments, and, on the other hand, in the active position, spaced from the stationary abutments to coact with the piece or pieces to be sawed.

According to an advantageous embodiment, the holding members comprise at least one bar extending along the piece to be sawed in a direction substantially parallel to the wire guide cylinders, this bar being provided with at least one elastomeric coating adapted to be applied against the slices of the piece to be sawed.

Preferably, said bar is mounted pivotably about a pivotal axis parallel to the wire guide cylinders on crosspieces mounted slidably on the guide elements.

Thanks to the mentioned characteristics, the holding device permits a particularly effective and reliable operation and a simple and less cumbersome construction.

According to another embodiment, the holding members comprise a thick liquid or a gel of a density higher than the machining liquid used, the thick liquid or gel being contained in a vat held in the active position such that said portion of the slices is at least partially immersed in the thick liquid or gel so that the slices will be immobilized.

These characteristics of the holding device permit obtaining an original and less costly solution to overcome the drawbacks of the mentioned surface undulations and irregularities.

As a modification, the holding device can also comprise as holding members, separation elements adapted to be introduced at least partially into the saw gaps between the slices to hold these latter, these separation elements being mounted on at least one support.

Thanks to these characteristics, the spacing between the slices can be maintained very precisely constant, even in the case of external forces acting on the slices undergoing sawing.

Advantageously, the separation elements are constituted by wires, strips, blades or walls of a thickness suitable to be introduced into the saw gaps.

The holding and separation of the sawed slices are thus carried out in a simple and effective manner.

According to a preferred embodiment, said at least one support is arranged in at least one vat mounted on said frame.

These characteristics permit easy integration of the sawed slices into a production chain.

Another embodiment is characterized by the fact that the holding device is constituted by a U shaped frame whose longitudinal branches are adapted to be applied laterally against the sawed slices by means of resilient members.

Such a frame can be mounted and removed by lateral displacement during sawing of the piece; this embodiment is hence particularly useful in the case of breakage of the sawing wire. During repair, the distance between the slices can be maintained constant thanks to this device and the wire can be easily replaced and reintroduced between the slices after repair. Moreover, the frame can also be used for transporting the piece after sawing before and during cutting off of the heel by which the slices are held on a temporary cutting support. The slices, separated from each other by regular spacing, do not adhere to the adjacent slices and can be cleaned and detached very easily.

BRIEF DESCRIPTION OF THE DRAWINGS

Other advantages will appear from the characteristics set forth in the dependent claims and from the description setting forth hereafter the invention in greater detail with the help of drawings which show schematically and by way of example several embodiments and modifications.

DESCRIPTION OF THE PREFERRED EMBODIMENTS

Figure 1:
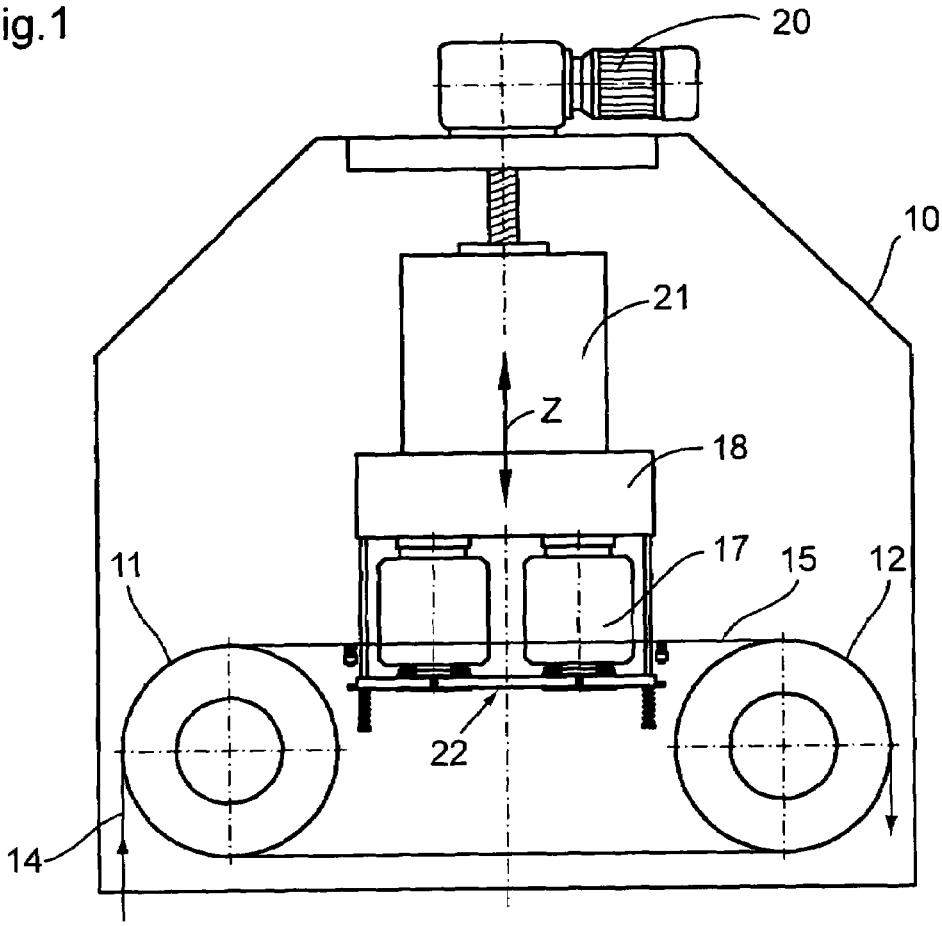
FIG. 1 is a front view of a first embodiment of the invention.
Figure 2:
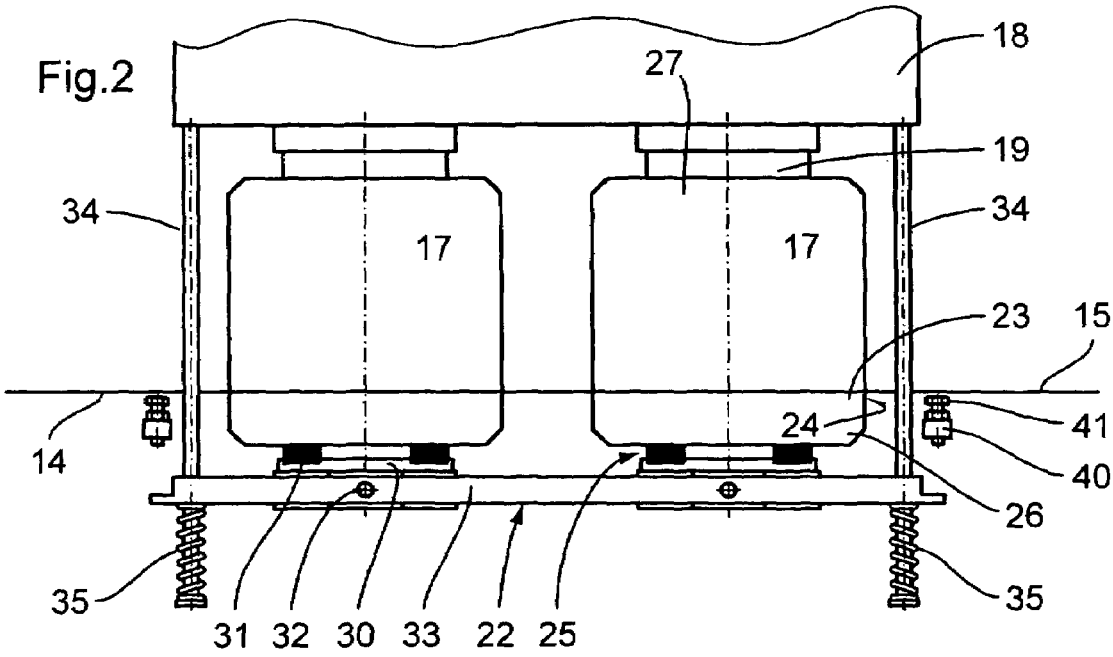
FIG. 2 is an enlarged fragmentary front view of this first embodiment.
Figure 3:
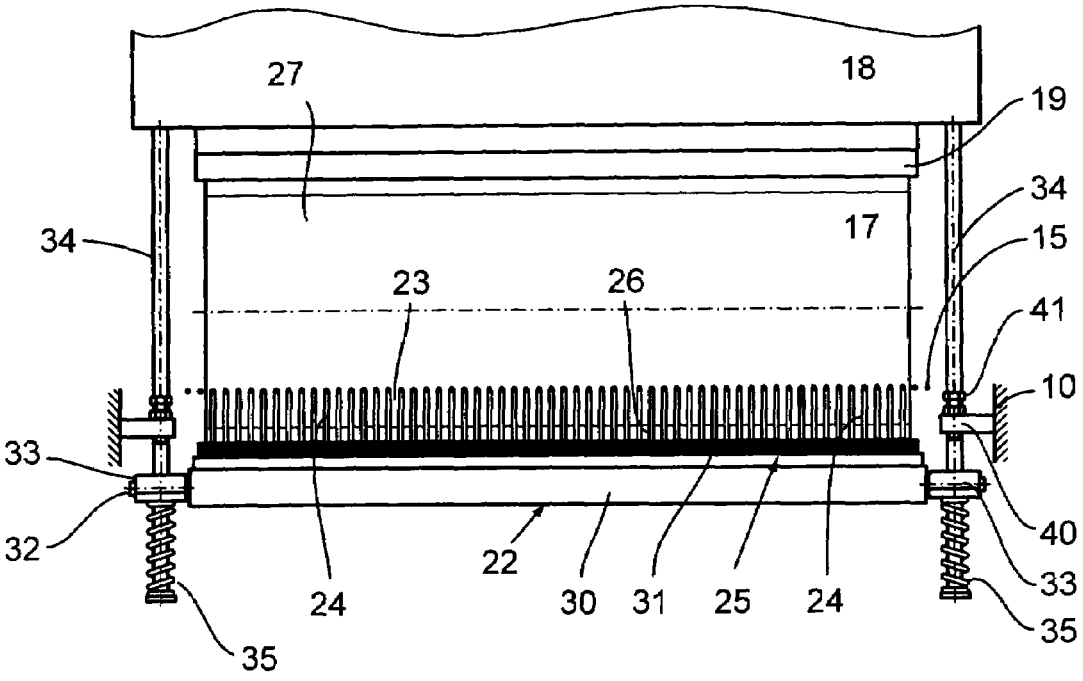
FIG. 3 is a side view of the holding device of FIG. 2.

With reference to FIG. 1 to 3, the sawing device according to the first embodiment comprises a frame 10 and wire guide cylinders 11, 12, here two in number, mounted on this frame with their axes disposed parallel, given of course that the device could have more than two wire guide cylinders.

The wire 14 is rolled from a supply bobbin, not shown, and then wound about the wire guide cylinders according to any possible winding manner to form at least one layer 15 of parallel wires in a sawing region. The wire is then returned to a suitable device (not shown), such as a receiving bobbin or a collection vat.

One, two or more pieces 17 to be sawed, such as ingots of a hard material, are mounted on a support table 18 by means of a temporary support 19. This support table 18 can be moved vertically in the Z direction thanks to a column 21 and a motor 20 to press the pieces 17 to be sawed against the layer 15 of wires.

The periphery of the wire guide cylinders 11, 12 is engraved with grooves which define the interval between adjacent wires of the layer 15 of wires, hence the thickness of the sawed slices. These latter are separated from each other by slots or sawing gaps.

The wire 14 is stretched and both guided and tensioned by the wire guide cylinders to move with alternate back and forth movement or continuously. This wire is preferably constituted by spring steel with a diameter comprised between 0.1 and 0.2 mm so as to saw blocks of hard material or of more particular composition, such as silicon, ceramic, compounds of the elements of groups III–V and II–VI, GGG (gadolinium gallium garnet), sapphire, etc., in slices of about 0.1 to 5 mm thickness. The abrasive agent is a commercial product and can be diamond, silicon carbide, alumina, etc., in a form fixed to the filament or in a free form in suspension in a liquid which serves as a transport for the abrasive particles.

The sawing device is, according to the invention, provided with a holding device 22 arranged so as to hold, in the course of sawing, the partially or entirely sawed slices 23 substantially parallel to each other and such that the width of the sawing gaps 24 is maintained substantially constant during sawing of the slices.

The holding device 22 comprises for this purpose holding members 25 adapted to coact with at least one portion 26 of the slices in the course of sawing. This portion 26 is in this case opposite the portion 27 of the piece 17 to be sawed by which this latter is fixed to the support table 18.

These holding members 25 comprise, in the embodiment of FIGS. 1 to 3, a longitudinal bar 30 with pieces to be sawed extending along the bar 30 in a direction substantially perpendicular to the wires of the layer 15 of wires. The bars 30 are provided with coatings 31 of elastomer adapted to be applied against the slices of the pieces to be sawed.

Each bar 30 is pivotally mounted about a pivotal axis 32 parallel to the wire guide cylinders 11, 12 on crosspieces 33. Thus, the coatings 31 can adapt themselves in an optimum manner to the pieces 17 to be sawed. The crosspieces 33 slide on rods 34 serving as guide elements secured to the support table 18. Resilient means in the form of coil springs 35 urge the crosspieces 33 and the longitudinal bars 30 in the direction on the one hand of the pieces 17 to be sawed and on the other hand of stationary abutments 40 secured to the frame 10.

When the pieces to be sawed are in an upper position spaced from the layer 15 of wires, the crosspieces 33 bear on the stationary abutments 40, and the holding members 25 are in this inactive position spaced from the pieces 17 to be sawed.

The pieces 17 to be sawed are, for sawing, lowered to enter into contact with the layer 15 of wires. After sawing a minimum distance, one centimeter for example, the elastomeric coatings 31 enter into contact with the pieces to be sawed and hold in this active position the sawed slices firmly in place thanks to the action of the springs 35, the stationary abutments 40 being then separated from the crosspieces 33. Adjustment screws 41 provided on the stationary abutments 40 permit determining exactly the position in which the holding members 25 enter in action.

The sawing can then continue until the opposite end of the piece to be sawed is reached, whilst the sawed slices 23 are maintained in position, permitting avoiding undulations, striations and other irregularities due to transverse movements of the slices. The slots or sawing gaps 24 have a constant width, permitting regular supply of abrasive particles and a constant sawing speed.

Figure 4:
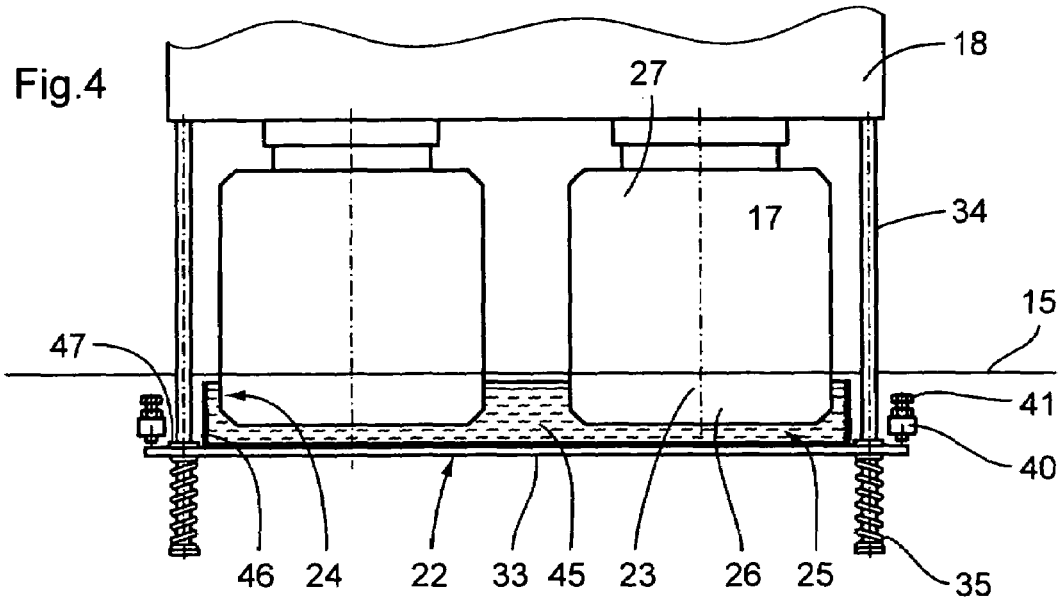
FIG. 4 is a fragmentary front view of a second embodiment.

The embodiment shown in FIG. 4 is similar to that of FIGS. 1 to 3, and it is only the holding device 22 which is of a different type. Thus, the holding members 25 comprise in this case a liquid or gel 45 of a higher density than the machining liquid used. This thick liquid or gel is contained in a vat 46 which is fixed on crosspieces 33 mounted slidably on rods 34. There could for example be used silicones of a suitable viscosity.

The crosspieces 33 are subject to the action of coil springs 35 and blocked in active position by stop rings 47 such that the lower portion 26 of the slices is at least partially immersed in the thick liquid or gel which penetrates partially into the sawing gaps 24 and thus immobilizes the sawed slices in parallel position.

Figure 5:
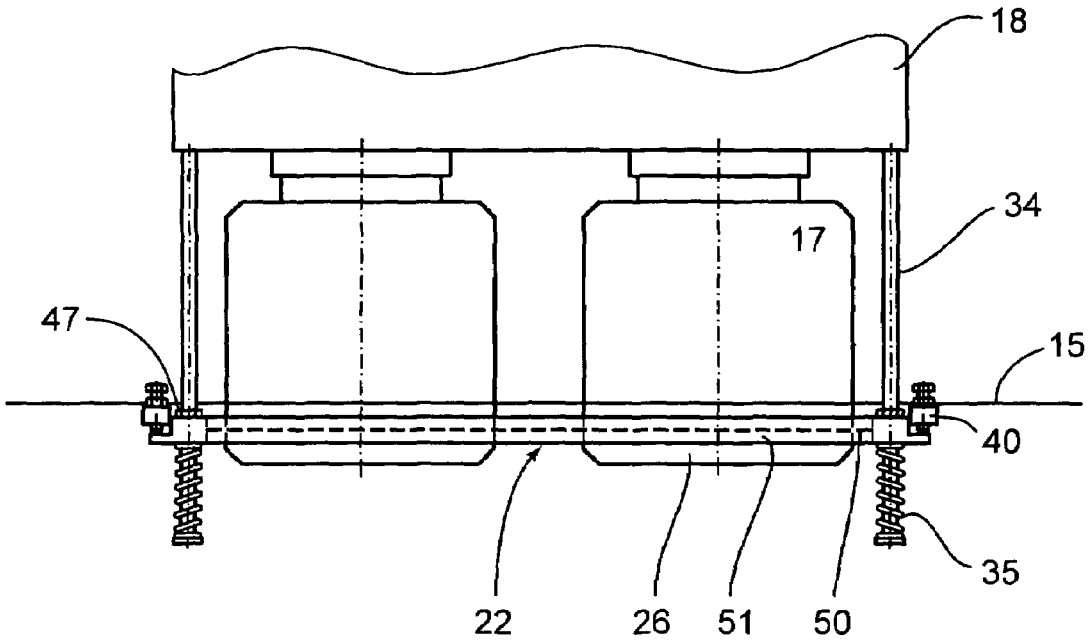
FIGS. 5 and 6 show a third embodiment in partial front view and partial perspective.
Figure 6:
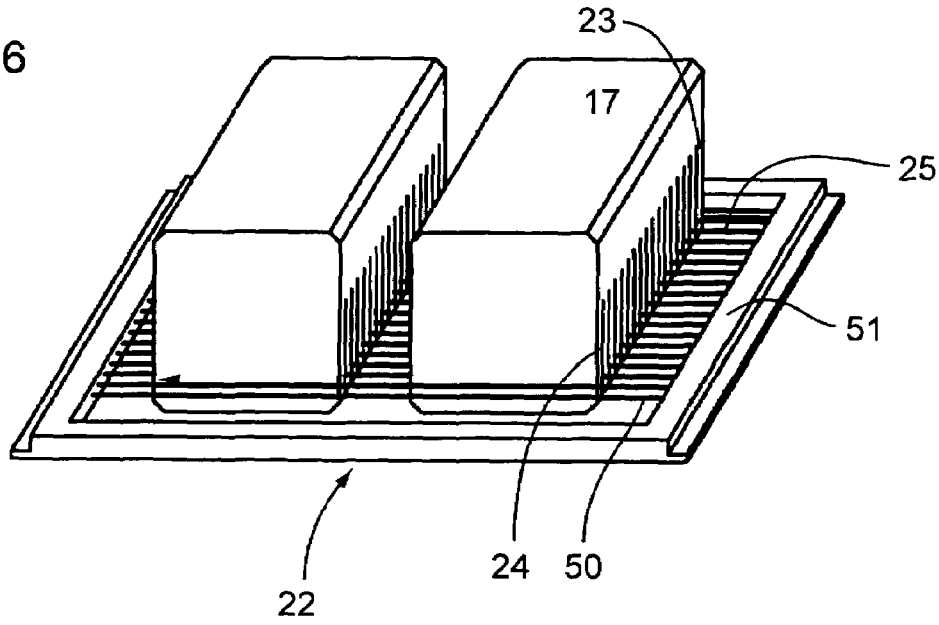

A third embodiment shown in FIGS. 5 and 6 comprises as the holding member 25 separating elements 50 adapted to be introduced at least partially into the gaps 24 between the slices 23 to hold these latter. In the illustrated embodiment, a series of wires 50 is stretched on a frame 51 and arranged parallel to the wires of the layer of wires 15. In active position, these wires 50 are introduced into the sawing gaps 24 between the slices 23 to maintain exactly the spacing between these latter. The frame 51 coacts in an inactive position with the stationary abutments 40 to space the wires 50 from the piece to be sawed against the action of the springs 35. When the assembly of support table 18, pieces 17 to be sawed, rods 34 and the frame 51 descends toward the active position and sawing begins, the frame 51 bears against the stop rings 47 provided on the rods 34 and thus remains in a fixed position relative to the pieces 17 to be sawed so as to coact with the lower portion 26 of the pieces to be sawed. The wires 50 could also be replaced by blades, ribbons, strips, walls of a suitable thickness, to be introduced into the sawing gaps 24 of the slices which are thus held in position without mutually touching.

Figure 7:
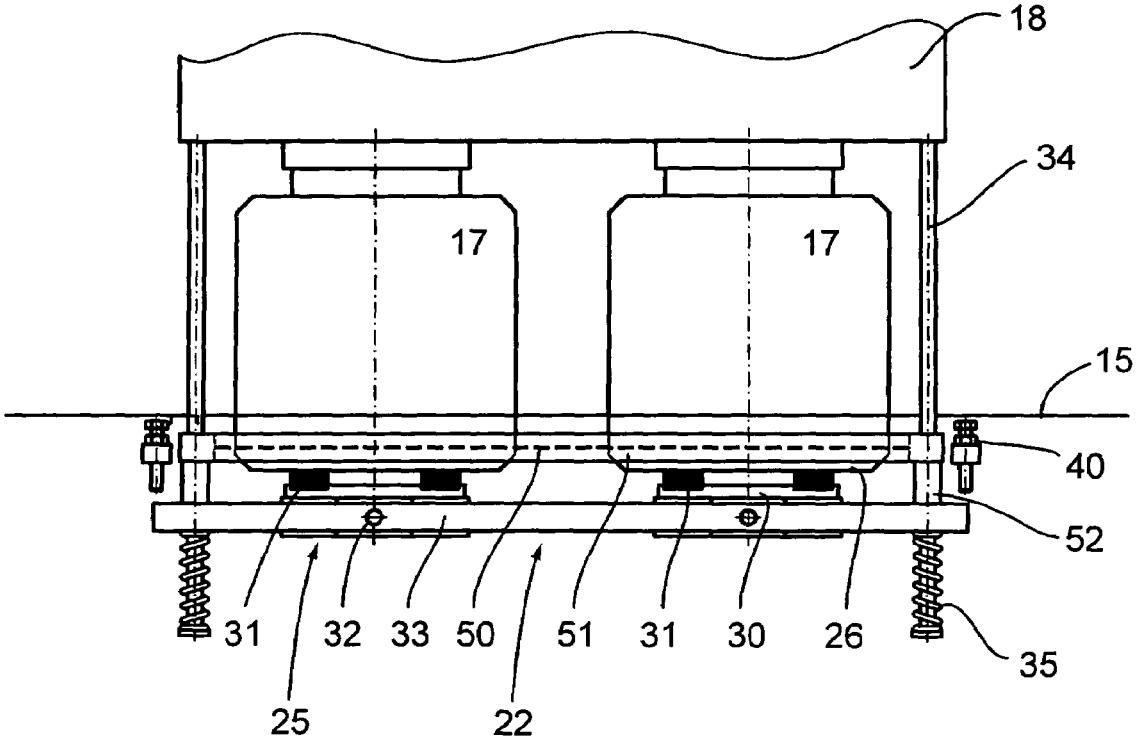
FIG. 7 is a partial front view of a modification combining the first and third embodiments.

The modification shown in FIG. 7 is a combination of the holding devices 22 according to the first and third embodiments. This modification comprises as holding members 25, on the one hand two longitudinal rods 30 with coatings 31 of elastomer urged against the pieces 17 to be sawed by springs 35, and on the other hand a frame 51 with wires 50 which are disposed within the saw gaps 24. The frame 51 is fixed by means of inter-fingering devices 52 on crosspieces 33 which coact with springs 35 and stationary abutments 40. This modification is particularly effective because it ensures double holding of the sawed slices by external bearing and by inter-fingering of the wires.

The other components of this sawing device and its operation remain similar to the first embodiment.

Figure 8:
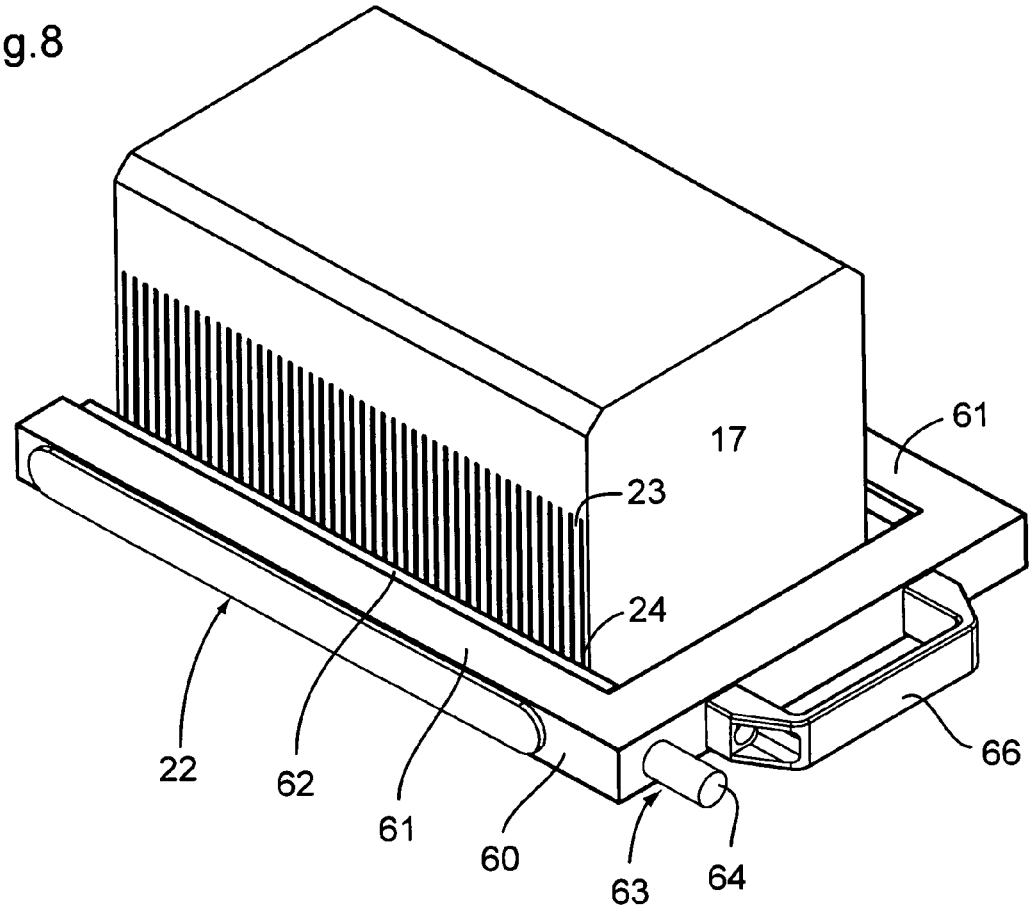
FIGS. 8 and 9 show a fourth embodiment in perspective and in partial front view.
Figure 9:
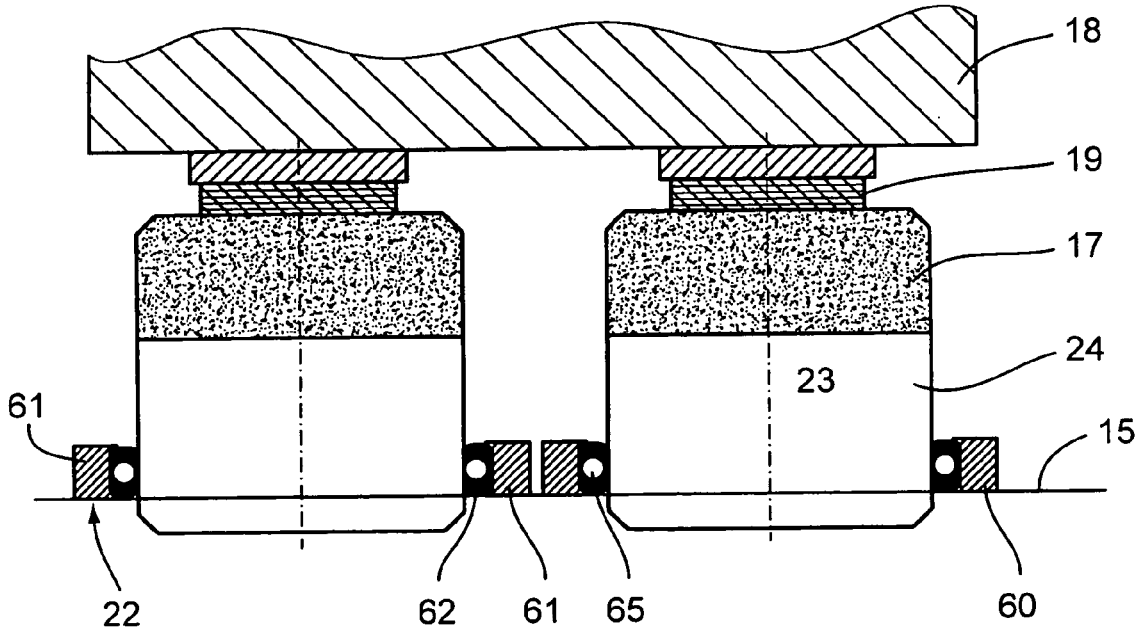
Figure 10:
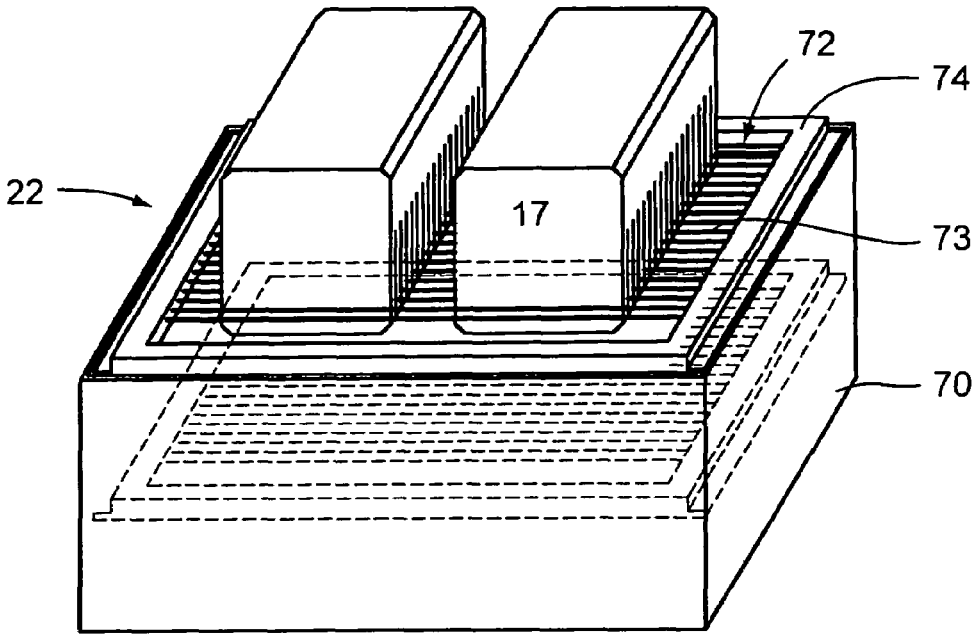
FIGS. 10 to 13 show a fifth embodiment in perspective, in side view, in front view, at the beginning and end of sawing.
Figure 11:
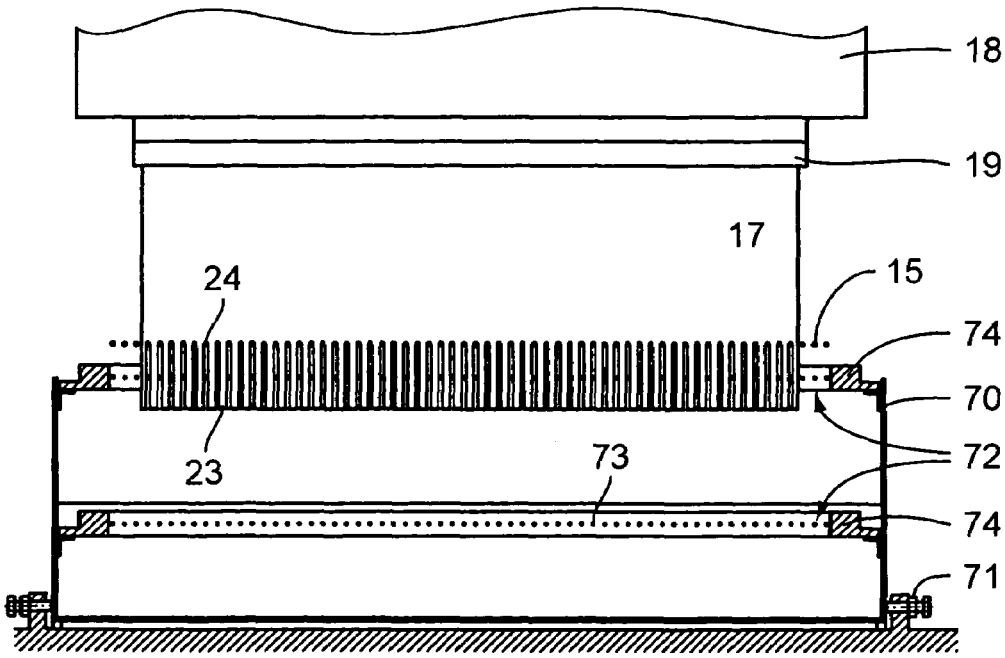
Figure 12:
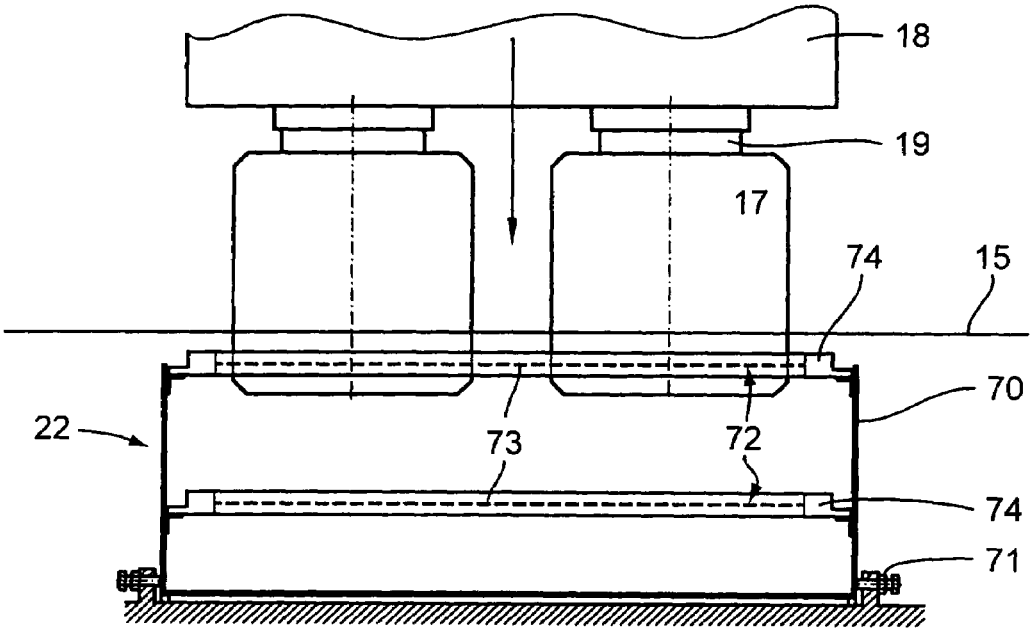
Figure 13:
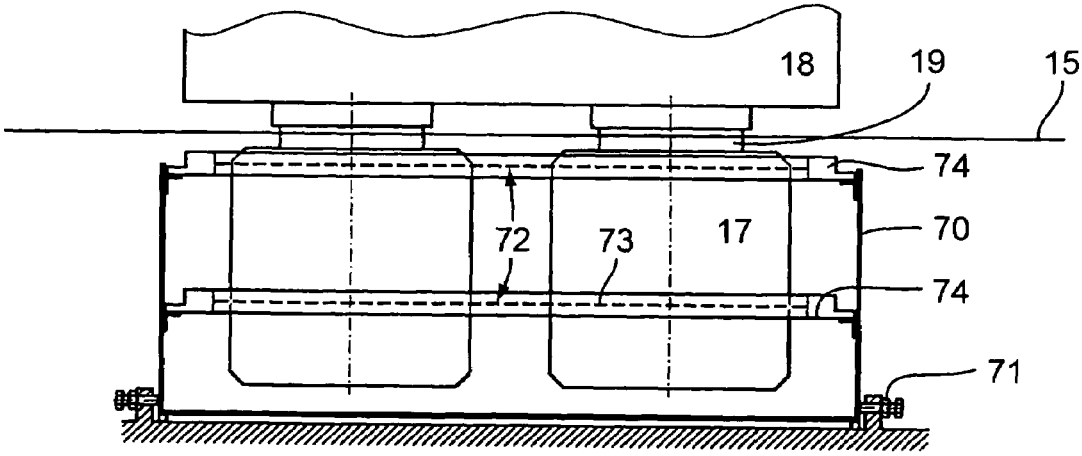

The fourth embodiment shown in FIGS. 8 and 9 comprises a holding device 22 comprising a U shaped frame 60. The longitudinal legs 61 of this frame are adapted to bear laterally against the sawed slices 23 of the piece 17 to be sawed, by means of resilient member 62. The force of application and holding can be obtained by a pneumatic device 63 comprising an inlet conduit 64 and internal conduits 65 permitting inflating resilient member 62. The force of application could also be obtained by other means, such as mechanical gripping of the longitudinal branches 61 toward each other by means of mechanical, pneumatic or hydraulic control.

During breakage of the wire, the frame 60 can be easily emplaced thanks to the handle 66 and then blocked by application of gripping.

After repair of the wire, this latter can be disposed in the sawing gaps 24, because the width of these latter remains constant. After removal of the frame 60, sawing can proceed. Without the holding device 22, it would be impossible to again thread the wire into the sawing gaps and the piece would thus have to be discarded.

A fifth embodiment is shown in FIGS. 10 to 13. In this embodiment, the holding device 22 is mounted on the frame 10 of the sawing device and comprises a vat 70 whose bottom and/or walls can be perforated or provided with flow means such that the sawing liquid and the abrasive can be removed from the vat. This vat is held by securement elements 71 on the frame 10 and provided with separation elements 72 adapted to be introduced into the sawing gaps 24 between the sawed slices 23 to maintain exactly the spacing between these latter.

The separation elements 72 are in this embodiment constituted by a series of wires 73 stretched on a mounting 74. The illustrated embodiment has two superposed frames mountings 74, but any other number of mountings from one to five could be mounted in the vat 70.

Thus, sawing can be carried out up to the temporary support 19 (FIG. 13), whilst the sawed slices 23 are held with regular spacing, which ensures high quality of the product without undulations, striations and irregularities. Moreover, the sawed slices are already separated from each other, which permits facilitated treatment and ultimate handling.

The slices could for example be removed from the sawing device directly into the vat 70.

Figure 14:
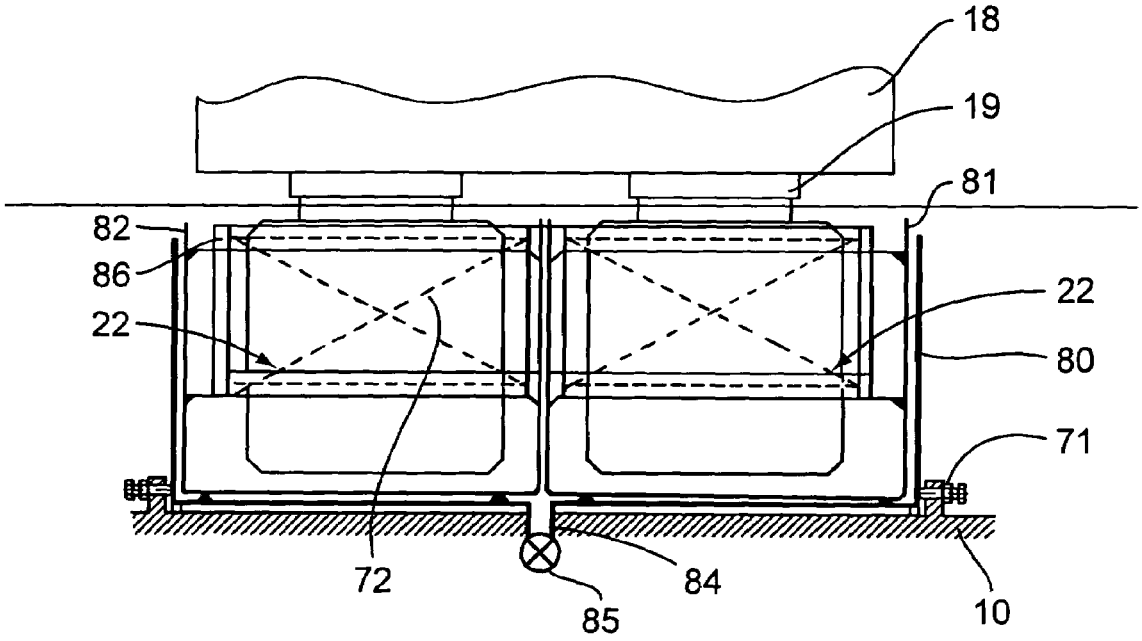
FIG. 14 shows a modification of the preceding embodiment.

According to a preferred embodiment shown in FIG. 14, two drawers 81, 82 could be disposed slidably in a vat 80 fixed on the frame 10.

Each of these drawers constitutes a holding device 22 for the slices of one or the other of the sawed ingots 17.

The bottom and sidewalls of these drawers 81, 82 could be perforated for the flow of sawing liquid. This latter could be retained in the vat 80 and evacuated through flow means 84 with a valve 85.

The holding device 22 also comprises separation elements 72 adapted to be introduced into the sawing gaps. These separation elements can be constituted by horizontal, oblique and/or diagonal wires stretched on one, two or several mountings 86. The wires could thus constitute two layers of crossed wires.

The separation elements could also be constituted by vertical walls fixed on sidewalls of the drawers. After sawing, the drawers 81, 82 with the sawed slices of each of the ingots could be removed from the sawing device.

Of course the embodiments described above are in no way limiting and can be the subject of any desired modification within the scope of the invention. In particular, one, two or several support tables 18 could support one or more than two pieces 17 to be sawed.

The relative movement between the support table or tables 18 and the layer 15 of wires could also be performed by movement of the layer of wires and by any suitable mechanical, pneumatic or hydraulic means. The sawing movement could also be effected in any other spatial direction than vertical.

The first embodiment of FIGS. 1 to 3 could also comprise lateral sawing means instead of vertical sawing means.

The holding device 22 could be adapted to the shape of the piece to be sawed. In the case of a circular section of this piece, the holding could be effected by a bar 30 matching the cylindrical surface.

The control of the force of application could be carried out by any mechanical, pneumatic and hydraulic means with or without stationary abutments.

The frame 51 of FIG. 6 with its wires or strips could also be mounted above the vat 46 in FIG. 4, combining the second and third embodiments.

Several holding members 25, as well as frames 51 or 60, could be superposed to ensure perfect holding under very difficult sawing conditions.

The separation elements 72 provided in the vat 70 or in the drawers 80 could be in any way horizontal, oblique, diagonal wires, complete or partial walls, strips, crosspieces, etc.

The invention claimed is:

1. Wire sawing device comprising at least one layer of wires stretched between at least two wire guide cylinders and held in position on the surface of said wire guide cylinders which define the interval between the wires of said layer of wires, and hence the thickness of the sawed slices separated from each other by sawing gaps, the wires being adapted to move with alternating or continuous movement whilst bearing against at least one piece to be sawed fixed on a support table, means being provided to carry out relative movement between the piece to be sawed and the layer of wires, wherein the sawing device comprises a holding device arranged to maintain, in the course of sawing, the partially or completely sawed slices substantially parallel to each other and such that the width of the sawing gaps is held substantially constant during sawing of the slices, wherein the holding device comprises holding members adapted to coact with at least a portion of the slices in the course of sawing, wherein the holding device comprises guide elements arranged on the support table, the holding members being mounted movably on the guide elements to be moved from an inactive position toward an active position, in which the holding members coact with the slices in the course of being sawed, and vice versa, wherein the holding members are urged by resilient members in the direction of stationary abutments, wherein the holding members are, on the one hand, in the inactive position, bearing against the stationary abutments and, on the other hand, in the active position, spaced from the stationary abutments to coact with the piece or pieces to be sawed, and wherein the holding members comprise at least one bar extending along the piece to be sawed in a direction substantially parallel to the wire guide cylinders, this bar being provided with at least one coating of elastomer adapted to be applied against the slices of the piece to be sawed.

2. Sawing device according to claim 1, wherein said bar is pivotally mounted about a pivotal axis parallel to the wire guide cylinders on crosspieces mounted slidably on the guide elements.

3. Wire sawing device comprising at least one layer of wires stretched between at least two wire guide cylinders and held in position on the surface of said wire guide cylinders which define the interval between the wires of said layer of wires, and hence the thickness of the sawed slices separated from each other by sawing gaps, the wires being adapted to move with alternating or continuous movement whilst bearing against at least one piece to be sawed fixed on a support table, means being provided to carry out relative movement between the piece to be sawed and the layer of wires, wherein the sawing device comprises a holding device arranged to maintain, in the course of sawing, the partially or completely sawed slices substantially parallel to each other and such that the width of the sawing gaps is held substantially constant during sawing of the slices, wherein the holding device comprises holding members formed by separation elements adapted to be introduced at least partially into the sawing gaps between the slices to maintain these latter, these separation elements being mounted on at least one support, wherein said at least one support is mounted on the support table and can be moved from an inactive position toward an active position, and wherein the holding members comprises at least one bar extending along the piece to be sawed in a direction substantially parallel to the wire guide cylinders, this bar being provided with at least one coating of elastomer adapted to be applied against the slices of the piece to be sawed, said at least one support being mounted above said bar.

4. Sawing device according to claim 3, wherein the separation elements are constituted by wires, strips, blades or walls of a suitable thickness to be adapted to be introduced into said sawing gaps.

* * * * *

UNITED STATES PATENT AND TRADEMARK OFFICE

CERTIFICATE OF CORRECTION

PATENT NO. : 7,114,424 B2
APPLICATION NO. : 10/752524
DATED : October 3, 2006
INVENTOR(S) : Andreas Muller et al.

It is certified that error appears in the above-identified patent and that said Letters Patent is hereby corrected as shown below:

On the title page, Item (73), should read as follows:

--(73) Assignee: HCT Shaping Systems S.A.,
Cheseaux-sur-Lausanne (CH)--.

Signed and Sealed this

Nineteenth Day of December, 2006

JON W. DUDAS
*Director of the United States Patent and Trademark Office*